US005884601A

United States Patent [19]

Robinson

[11] Patent Number: 5,884,601

[45] Date of Patent: Mar. 23, 1999

[54] ELECTRIC MOTOR DRIVEN PRIMARY OIL PUMP FOR AN INTERNAL COMBUSTION ENGINE

[75] Inventor: David C. Robinson, London, Canada

[73] Assignee: Siemens Canada Limited, Mississauga, Canada

[21] Appl. No.: 17,274

[22] Filed: Feb. 2, 1998

[51] Int. Cl.[6] ..... F01M 1/00

[52] U.S. Cl. ..... 123/196 S; 123/196 A

[58] Field of Search ..... 123/196 S, 196 A

[56] References Cited

U.S. PATENT DOCUMENTS

| | | | |
|---|---|---|---|
| 1,769,258 | 7/1930 | Goodrich . | |
| 2,110,662 | 5/1938 | Fisher . | |
| 2,382,426 | 8/1945 | Kocher . | |
| 2,500,524 | 3/1950 | Davis . | |
| 3,561,565 | 2/1971 | Woor et al. . | |
| 4,156,407 | 5/1979 | Moll et al. | 123/196 AB |
| 4,471,727 | 9/1984 | Odashima . | |
| 4,531,485 | 7/1985 | Murther . | |
| 4,825,826 | 5/1989 | Andres | 123/196 S |
| 4,875,551 | 10/1989 | Lulich | 123/196 S |
| 4,940,114 | 7/1990 | Albrecht . | |
| 5,000,143 | 3/1991 | Brown . | |
| 5,018,491 | 5/1991 | Fish . | |
| 5,056,622 | 10/1991 | Vermeulan . | |
| 5,159,313 | 10/1992 | Kawai et al. . | |
| 5,195,476 | 3/1993 | Schwarz . | |
| 5,315,971 | 5/1994 | Yamada . | |
| 5,339,776 | 8/1994 | Regueiro | 123/196 AB |
| 5,474,428 | 12/1995 | Kimura et al. . | |
| 5,511,522 | 4/1996 | Tran . | |
| 5,526,783 | 6/1996 | Ito et al. | 123/196 S |

*Primary Examiner*—John T. Kwon

[57] ABSTRACT

A primary pump system for lubricating an internal combustion engine includes a pump constructed and arranged to pump lubricant to an engine prior to engine cranking and continuously during operation of the engine. A variable speed electric motor is constructed and arranged to drive the pump independently of engine speed. A controller controls operation of the motor and thus the operation of the pump. An engine load sensor senses a load on the engine. The controller is responsive to a signal received from the engine load sensor to control the motor so that the pump may supply lubricant to the engine in accordance with engine load.

16 Claims, 1 Drawing Sheet

ELECTRIC MOTOR DRIVEN PRIMARY OIL PUMP FOR AN INTERNAL COMBUSTION ENGINE

BACKGROUND OF THE INVENTION

This invention relates to an oil pump for an internal combustion engine and more particularly, to an electrically operated primary oil pump which delivers oil prior to engine cranking and continuously during operation of the engine and independently of engine speed.

DESCRIPTION OF RELATED ART

Conventional internal combustion engines are typically lubricated with a mechanical pump powered by the engine via belts or gears. The speed of the pump and therefore the rate of oil flow though the engine are determined by the engine speed. The pump is in communication with an oil pan in which oil accumulates before the engine is started. The pump does not start pumping oil to the engine until after the engine has started. Thus, when lubrication is most critical, e.g., at the instant of ignition, most of the oil remains in the oil pan and the bearing surfaces of the engine will receive fresh oil only after the engine has started. During the initial engine crank, only residual oil which has not drained back to the crank case remains on the bearing surfaces. During this period, until the conventional mechanical oil pump is functioning at rated speed and output capacity, metal to metal wear can occur at bearing surfaces.

Auxiliary electrically operated oil pumps have been provided to operate at engine start-up so as to ensure oil flow as soon as possible. However, once the oil pressure has reached a predetermined state, the auxiliary oil pump is turned-off and a mechanical oil pump, powered by the engine, is initiated and becomes the primary oil pump which delivers oil based on engine speed. The use of mechanically-driven oil pumps increases the number of components and machining operations in the engine block.

Oil not only lubricates engine parts, but oil is also important in engine cooling. With the use of a mechanical oil pump powered by the engine, the amount of lubrication and cooling of the engine is dependent only on engine speed and is not relative to the work load of the engine.

There is a need to provide a variable speed, electrically operated primary oil pump for an internal combustion engine which pumps oil immediately and operates continuously while the engine is operating and independently of engine speed.

SUMMARY OF THE INVENTION

An object of the present invention is to fulfill the need referred to above. In accordance with the principles of the present invention, this objective is obtained by providing a primary pump system for lubricating an internal combustion engine. The primary pump system includes a pump constructed and arranged to pump lubricant to an engine prior to engine cranking and continuously during operation of the engine. A variable speed electric motor is constructed and arranged to drive the pump independently of engine speed. A controller controls operation of the electric motor and thus the operation of the pump. An engine load sensor senses a load on the engine. The controller is responsive to a signal received from the engine load sensor to control the motor so that the pump may supply lubricant to the engine in accordance with engine load.

Other objects, features and characteristic of the present invention, as well as the methods of operation and the functions of the related elements of the structure, the combination of parts and economics of manufacture will become more apparent upon consideration of the following detailed description and appended claims with reference to the accompanying drawing, all of which form a part of this specification.

DETAILED DESCRIPTION OF THE PRESENTLY PREFERRED EXEMPLARY EMBODIMENTS

Figure 1:
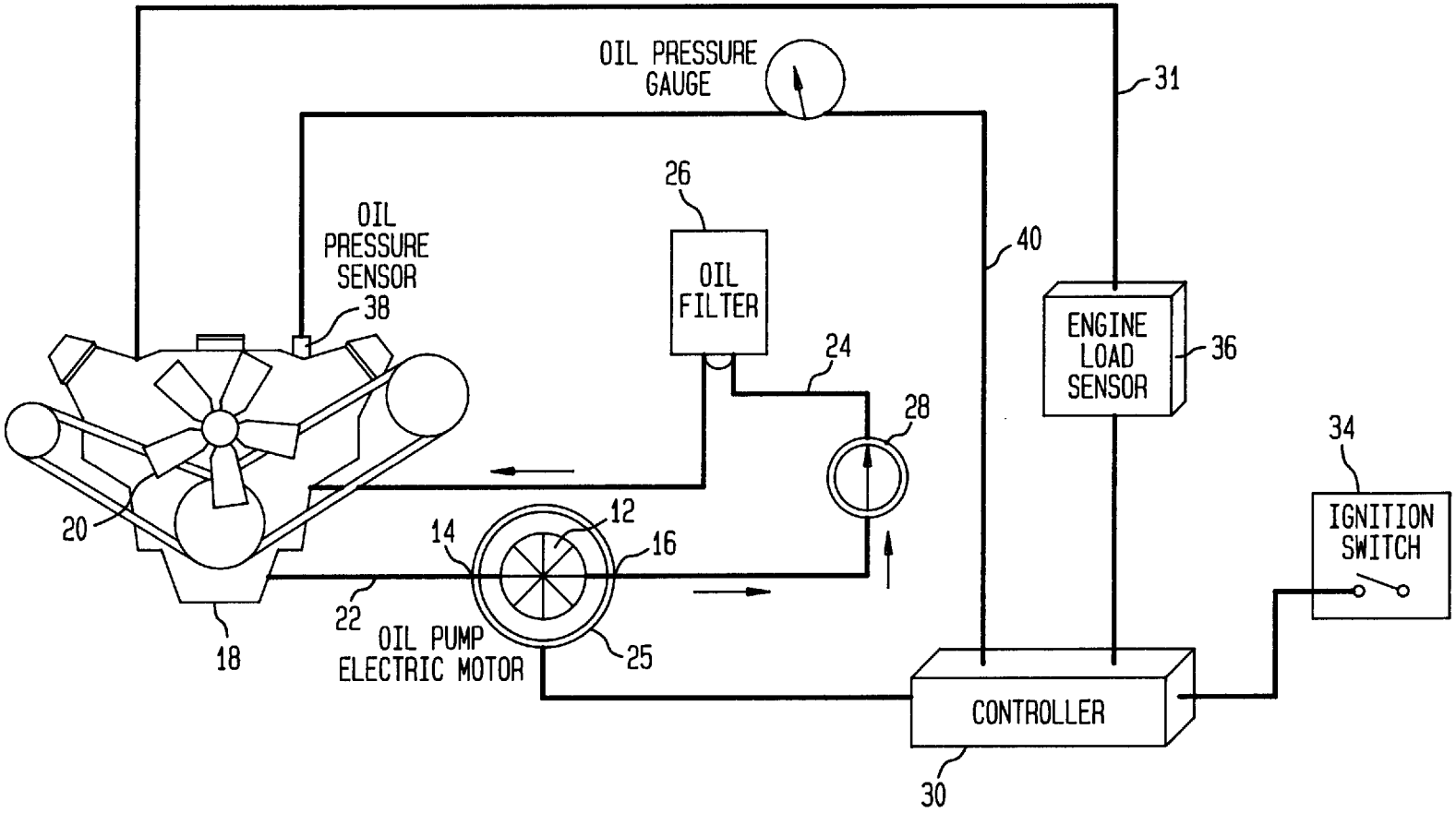
FIG. 1 is a block diagram of an electric primary oil pump system provided in accordance with the principles of the present invention.

Referring to FIG. 1, a pump-motor system is shown, generally indicated at 10, provided in accordance with the principles of the present invention.

The pump-motor system 10 includes an oil pump 12 having an inlet 14 and an outlet 16. The inlet 14 of the pump 12 may be connected to an oil sump or reservoir 18 of engine 20 via output line 22. Oil under pressure is returned to the engine 20 via connecting line 24. The pump 12 is driven by an electric motor 25. In the illustrated embodiment, the electric motor 25 is preferably a variable speed electric motor powered by a battery (not shown). Thus, the motor 25 rotates the pump drive shaft (not shown) through a wide range of rotational speeds to pump oil or other lubricant at various flow rates through the engine 20. Although, in the illustrated embodiment, oil is pumped from an oil pan of the engine 20, it can be appreciated that a separate oil tank may be provided and mounted, for example, under a fender of a vehicle.

An oil filter 26 is disposed in connecting line 24 to filter the oil which is returned to the engine 20. In addition, valve structure 28 in the form of a one-way check valve is provided in the connecting line 24 to prevent oil from flowing backwards to the pump 12.

In accordance with the invention, the electric motor 25 may be controlled by a controller 30 which may include a processor. The controller 30 is electrically connected to an ignition switch 34. Thus, when the ignition switch 34 is actuated, the controller 30 initiates operation of the motor 25 which in turn drives the pump 12 to permit oil flow at required pressure prior to engine cranking and during the engine start-up period to reduce engine wear. Furthermore, the pump 12 is the primary oil pump and operates continuously to deliver oil to the engine. When the ignition switch 34 is deactivated, the controller 30 terminates operation of the motor 25 and thus the oil pump 12. Since the motor 25 is operated electrically and not powered mechanically by the engine by belts or gears, the motor 25 may control the pump 12 independently of engine speed. Thus, oil may be delivered to the engine immediately upon ignition and accordingly, there is no possibility of inadequate lubrication from a time of ignition until the engine is at rated speed and output capacity, which may occur in conventional mechanically driven pumps.

The oil pump 12 is the engine's primary oil pump and may be configured to provide lubricating oil at the maximum required pressure continuously during operation of the engine 20. As noted above, however, the electric motor 25 operates at various speeds to control the oil pump 12, permitting the oil pump 12 allow the lubrication rate to be optimized to match the engine work load. Thus, in accordance with the invention, an engine load sensor 36 is electrically connected to the controller 30 via connection 31. In one embodiment of the invention, the engine load sensor 36 is an RPM sensor which monitors the engine speed at the inductor of the ignition coil of the engine 20. The controller 30 controls the speed of motor 25 based on the output of the load sensor 36 during operation of the engine. For example, when the engine 20 is operating at high RPMs, the load sensor 36 will sense a high RPM condition and the controller 30 will control the motor 25 to operate at high speed so as to allow for maximum lubrication and oil flow. It can be appreciated that the RPM sensor may be operatively associated with any part of the engine or vehicle where RPM can be determined. As indicated above, since the motor 25 is electrically operated, it operates independently of engine speed. However, the speed of the motor 25 may be controlled by controller 30 in response to engine RPM.

As shown in FIG. 1, the engine 20 includes an oil pressure sensor 38 which senses engine oil pressure. The sensor 38 is electrically connected to the controller 30 via connection 40 such that a predetermined oil pressure must be reached before the controller 30 will permit ignition to take place. The oil pressure sensor 38 also allows for the speed of the oil pump motor 25 to be related to oil pressure. As a engine wears, oil pressure tends to decrease due to greater clearances between engine mating parts. Since the speed of the motor 25 of the oil pump 12 may be related to oil pressure, engine oil pressure can be maintained at the designed specification pressure.

Since the motor 25 and oil pump 12 operate independently of the engine RPM, the energy required to operate the motor 25 may be minimized and hence offer fuel economy and power savings. Further, the pump and motor of the invention may be mounted anywhere outside of the engine block. This may advantageously reduce the number of components and machining operations in the engine block.

The pump and motor may be optimized to provide efficient circulation and constant pressure at a narrower speed range of the electric motor (approximately 1,000 to 3,000 RPM) as compared to the engine operating speed (1,000 to 8000 RPM). Oil pressure is controlled by the electric motor speed independently of the engine speed and without the need for a pressure relief valve in the oil galley system. If the pump and motor are mounted outside of the engine block, check valves could be provided to restrict oil from draining backwards from the galleys and therefore present oil to the bearings immediately upon engine start-up.

It has thus been seen that the objects of this invention have been fully and effectively accomplished. It will be realized, however, that the foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A primary pump system for lubricating an internal combustion engine, said pump system comprising:

a pump constructed and arranged to pump lubricant to an engine prior to engine, cranking and continuously during operation of the engine, an electric motor constructed and arranged to operate said pump at variable speeds and independently of engine speeds;

a controller to control an operating speed of said motor and thus operation of said pump, and an engine load sensor to sense a load on the engine, said engine load sensor being operatively associated with said controller, said controller being responsive to a signal received from said engine load sensor to control speed of said motor so that said pump supplies lubricant to the engine in accordance with engine load.

2. The system according to claim 1, further comprising an ignition switch electrically connected to said controller so that said controller controls operation of said motor based on a condition of said ignition switch.

3. The system according to claim 1, wherein said engine load sensor is a an RPM sensor constructed and arranged to be operatively associated with the engine to monitor speed of the engine and being electrically connected to said controller, said controller controlling a speed of said motor based on engine speed.

4. The system according to claim 3, further including an oil pressure sensor constructed and arranged to be operatively associated with the engine to monitor pressure in the engine and being electrically connected to said controller, said controller controlling a speed of said motor based on engine pressure.

5. The system according to claim 1, further including an oil pressure sensor constructed and arranged to be operatively associated with said engine to monitor pressure in the engine and being electrically connected to said controller, said controller being constructed and arranged to prevent ignition until a predetermined pressure value is achieved in the engine.

6. The system according to claim 1, in combination with an internal combustion engine and a source of engine lubricant, said lubricant source being in fluid communication with said pump, an outlet of said pump being connected to said engine via a connecting line such that said engine lubricant flows from said pump to said engine through said connecting line.

7. The system according to claim 5, further including valve structure in said connecting line to prevent engine lubricant from flowing back to said pump.

8. The system according to claim 7, wherein said valve structure comprises a one-way check valve.

9. An engine lubrication system comprising:

an internal combustion engine;

a source of engine lubricant;

a pump having an inlet in fluid communication with said source of engine lubricant and having an outlet in communication with said engine to return engine lubricant to said engine, said pump being constructed and arranged to pump engine lubricant from said source thereof to said engine prior to engine cranking and continuously during operation of said engine, an electric motor constructed and arranged to operate said pump at variable speeds and independently of engine speed;

a controller to control an operating speed of said motor and thus operation of said pump, and an engine load sensor to sense a load on said engine, said engine load sensor being operatively associated with said controller, said controller being responsive to a signal received from said engine load sensor to control speed of said motor so that said pump supplies engine lubricant to said engine in accordance with engine load.

10. The system according to claim 9, further comprising an ignition switch electrically connected to said controller so that said controller controls operation of said motor based on a condition of said ignition switch.

11. The system according to claim 9, wherein said engine load sensor is a an RPM sensor operatively associated with said engine to monitor speed of the engine and being electrically connected to said controller, said controller controlling a speed of said motor based on engine speed.

12. The system according to claim 9, further including an oil pressure sensor operatively associated with said engine to monitor pressure in the engine and being electrically connected to said controller, said controller controlling a speed of said motor based on engine pressure.

13. The system according to claim 10, further including an oil pressure sensor operatively associated with said engine to monitor pressure in said engine and being electrically connected to said controller, said controller being constructed and arranged to prevent ignition until a predetermined pressure value is achieved in said engine.

14. The system according to claim 9, further including valve structure in a connecting line connecting said outlet of said pump to said engine to prevent engine lubricant from flowing back to said pump.

15. The system according to claim 14, wherein said valve structure comprises a one-way check valve.

16. A method of lubricating an internal combustion engine comprising:

providing a pump and an electric motor to drive said pump, and operating said electric motor such that said pump delivers lubricant to an engine prior to engine cranking;

sensing a load on the engine; and controlling a speed of said electric motor based on the sensed engine load to operate said pump continuously during operation of the engine.

* * * * *